US010392153B2

(12) United States Patent
Mehta

(10) Patent No.: US 10,392,153 B2
(45) Date of Patent: Aug. 27, 2019

(54) VENTILATION BOARDS AND METHODS FOR MANUFACTURING VENTILATION BOARD

(71) Applicant: Vinay K. Mehta, Maharashtra (IN)

(72) Inventor: Vinay K. Mehta, Maharashtra (IN)

( * ) Notice: Subject to any disclaimer, the term of this patent is extended or adjusted under 35 U.S.C. 154(b) by 0 days.

(21) Appl. No.: 15/754,454

(22) PCT Filed: Aug. 24, 2016

(86) PCT No.: PCT/IN2016/050282

§ 371 (c)(1),
(2) Date: Feb. 22, 2018

(87) PCT Pub. No.: WO2017/033210

PCT Pub. Date: Mar. 2, 2017

(65) Prior Publication Data

US 2019/0023448 A1 Jan. 24, 2019

(30) Foreign Application Priority Data

Aug. 24, 2015 (IN) ..... 3222/MUM/2015

(51) Int. Cl.

| | |
|---|---|
| ***B65D 65/40*** | (2006.01) |
| ***B65D 5/42*** | (2006.01) |
| ***B31B 50/14*** | (2017.01) |
| ***B31B 50/25*** | (2017.01) |
| ***B65D 85/36*** | (2006.01) |
| *B31B 110/35* | (2017.01) |
| *B31B 120/70* | (2017.01) |

(52) U.S. Cl.
CPC ..... *B65D 5/4295* (2013.01); *B31B 50/142* (2017.08); *B31B 50/252* (2017.08);
(Continued)

(58) Field of Classification Search
CPC .... B65D 5/4295; B65D 65/403; B65D 85/36; B65D 2585/366; B31B 50/142; B31B 50/252; B31B 2110/35; B31B 2585/366
(Continued)

(56) References Cited

U.S. PATENT DOCUMENTS 2,533,773 A 12/1950 De La Foret
4,441,626 A * 4/1984 Hall ..... B31F 1/2813 229/120

(Continued)

FOREIGN PATENT DOCUMENTS

| | | | |
|---|---|---|---|
| EP | 1902964 | A1 | 3/2008 |
| WO | 2006087731 | A1 | 8/2006 |
| WO | 2015049692 | A1 | 4/2015 |

OTHER PUBLICATIONS

International Search Report and Written Opinion issued in corresponding PCT Application No. PCT/IN2016/050282, dated Jan. 30, 2017.

*Primary Examiner* — Corey N Skurdal
(74) *Attorney, Agent, or Firm* — Andrus Intellectual Property Law, LLP

(57) ABSTRACT

A ventilation board is manufactured from a corrugated board comprising at least one depressed portion on both sides of the board in such a way that flutes of the corrugated layer between said depressed portions are exposed to form a plurality of passageways for passage of fluid across the board, in other words, from one side to the other side of the board. The depressed portion is formed by forming a cut on the surface of each side of the board in such a way that the cut penetrating from one side of the board passes through the corrugated layer of the corrugated board but does not pass through the other side of the corrugated board, and depressing the cuts in such a way that the flutes between the depressed portion get exposed in order to provide passageways for passage of the fluid across the board.

29 Claims, 7 Drawing Sheets

(52) U.S. Cl.
CPC ..... *B65D 65/403* (2013.01); *B65D 85/36* (2013.01); *B31B 2110/35* (2017.08); *B31B 2120/70* (2017.08); *B65D 2585/366* (2013.01)

(58) Field of Classification Search
USPC ..... 229/103.11, 120, 403, 902, 906
See application file for complete search history.

(56) References Cited

U.S. PATENT DOCUMENTS 5,094,385 A 3/1992 Antczak et al.
8,662,378 B2 * 3/2014 Mehta ..... B65D 5/4295 229/103.11
9,452,860 B2 * 9/2016 Mehta ..... B65D 5/4295
9,994,354 B2 * 6/2018 Volpis ..... B65D 5/4295
2002/0079357 A1 * 6/2002 Tulkoff ..... B65D 5/48024 229/120.32
2010/0155460 A1 * 6/2010 Mehta ..... B65D 5/4295 229/103.11
2010/0193578 A1 * 8/2010 Sanders ..... B65D 65/403 229/120
2011/0045957 A1 * 2/2011 Mehta ..... B65D 5/4295 493/344
2013/0266772 A1 * 10/2013 Fujii ..... B32B 3/28 428/178
2017/0291754 A1 * 10/2017 Rotter ..... B32B 3/28

* cited by examiner

VENTILATION BOARDS AND METHODS FOR MANUFACTURING VENTILATION BOARD

CROSS-REFERENCE TO RELATED APPLICATIONS

This application is the U.S. national stage application of International Application PCT/IN2016/050282, filed Aug. 24, 2016, which international application was published on Mar. 2, 2017, as International Publication WO 2017/033210 in the English language. The international application is incorporated herein by reference, in its entirety. The international application claims priority to Indian Patent Application No. 3222/MUM/2015, filed Aug. 24, 2015, which is incorporated herein by reference, in its entirety.

FIELD OF THE PRESENT INVENTION

The present invention relates to a ventilation board, a method for manufacturing the ventilation board, and a device for manufacturing the ventilation board. The present invention also relates to articles made by said ventilation board.

BACKGROUND OF THE PRESENT INVENTION

Ventilation is required in panels used for making boxes, drums, cans, bags, containers, cases, pallets, crates, shipping containers, etc. Many of these applications are used for storage purposes where, commonly, ventilation or insulation or both are important considerations. Both of these considerations are important in designing fast food packaging for take away or for deliveries.

Fast food packaging has three aims. The packaging, such as, a carton or other sort of box, should retain the heat of the food it contains, it should prevent the food from becoming soggy as the result of steam condensing into water on the inner ply of the carton, and also should be cost effective, as the packaging is usually disposable.

Generally, packaging that is widely used at present achieves the last aim with only one of the first two aims. It has been difficult to create packaging, which meets all three objectives simultaneously.

Known packaging fails to meet all of these three aims partly because of the following reasons. As the packaging and the food within it, are transported, heat from the food and packaging disperses and steam is released into the atmosphere within the packaging. The packaging is cooler than the food. As the heated steam from the food rises vertically above the food, it rises towards the lid, or covering, of the packaging. On contact with the lid, the steam condenses into water on the lid transferring heat to the packaging. The condensed water is then free to fall back on to the food making it soggy and reducing its taste.

Cartons made of Styrofoam attempt to overcome this problem by retaining the heat within the carton, as Styrofoam is a highly insulative material. However, after time, heat still escapes from the carton, so that condensation forms within the carton above the food.

Another carton that is well known is made of corrugated paperboard. Corrugated paperboard is used to make the carton because of properties inherent in its corrugated structure. The inherent corrugated structure imparts resistance to, and distribution of, forces applied parallel to and perpendicular to the corrugations of A the corrugated structure.

When a force is applied in the direction of the flutes in the corrugated structure, the flutes are in compression, and, acting like columns, thereby resist the compression force. The corrugated structure therefore improves the compression strength of the board. When the force is applied perpendicular to the direction of the flutes of the corrugated structure, the flutes deform, absorbing the energy of the impacting force and distributing the force through the board. Thus, the corrugated structure improves the strength of the board by providing resistance to the applied force.

Where multilayer corrugated board is used, the layers of the board are generally used with their flutes parallel to the flutes of the adjacent layers. Thus, in a multilayer board it is possible to withstand compressive forces and forces that would normally deform the flutes. In these circumstances, the board remains rigid. The food within a carton made of paperboard, typically of three or five ply, is protected from physical impacts during transportation. Y et, even with these advantages, condensation would form on the plys on the inside of this carton, making the food soggy on delivery.

Therefore, as these types of known cartons show, there is a need in the fast food industry, preferably those establishments that sell pizzas, for packaging that retains the heat of the hot food without unwanted water condensation forming within the carton, particularly on the underside of the lid and beneath the pizza dough.

Developments have been made to allow some of the steam out of such a carton. One such development is the provision of holes or slits on the sides, or near the edges, of the carton. However, for products such as pizzas, the hot air and steam rises above from the pizza cools the steam sufficiently to condense into water on the under ply of the lid above the food before the air and the steam reaches the holes. The holes and slits in the carton are not located directly above the food, which would allow the steam to escape quickly from the carton. The location of holes above the food could permit foreign objects and contaminants to fall on to the food. Furthermore, the use of such direct holes through the panels of the board reduces the strength of the board.

Further, various boxes including above are available, however, they are either inefficient to keep the food hot or complex and difficult to manufacture and expensive. Further, they may require modifications in the manufacturing of the corrugated board which may disturb the corrugation manufacturing lines and high precision to manufacture the board. Also, it may require to modifications based on the type of the ventilation require which will make an expensive affair for the corrugation board manufacturing company.

Therefore, there is a need of a means that solves at least one of the aforementioned problems.

SUMMARY OF THE PRESENT INVENTION

Hence, the object of the present invention is to provide a method for manufacturing a ventilation board, and a ventilation board that when used to make a panel defining an enclosed space, such as a carton, solves one of the aforementioned problems demonstrated by the shortcomings of known fast food packaging. That is, to provide sufficient ventilation of the carton/box so that water condensed from hot food vapours does not run on to the hot food in the carton so that the hot food in the carton is kept warm and less soggy.

Another object of the present invention is to provide an apparatus for manufacturing the ventilation board of the present invention.

Accordingly, the present invention in the first aspect provides a method of manufacturing a ventilation board comprising steps of providing a three or more ply corrugated board having a top liner, a bottom liner, and an intermediate corrugated layer, said intermediate corrugated layer having a plurality of flutes forming a plurality of crests and troughs;

forming at least one cut passing through the top liner and the corrugated layer such that the cut does not penetrate through the bottom liner;

forming at least one cut passing through the bottom liner and the corrugated layer such that the cut does not penetrate through the top liner and said cut being mutually adjacent and non-overlapping to the cut formed on the top liner; and depressing portions of the top and bottom liners along with the flutes of corrugated layer at the cuts formed on the top and bottom liners, respectively, such that the crests and troughs of flutes between said depressed portions are exposed to form a plurality of passageways for passage of fluid across the board.

According to an embodiment of the method of the present invention, the step of forming the cuts and the step of depressing the portions at the cuts can be performed simultaneously, subsequently, together or separately.

According to the preferable embodiment of the present invention, the step of forming cuts preferably includes forming two parallel cuts on the liner and the step of depressing includes depressing a portion formed between the two parallel cuts to form a depressed portion. Alternatively, single cut can be formed and a portion of one of the adjacent sides of the cut can be depressed to expose the flutes in order to connect the flutes exposed by the depressed portion of the other side.

According to one another embodiment of the present invention, the step of providing a three or more ply corrugated board includes forming the corrugated board or providing a corrugated board before making a flat pack blank of the foldable box or providing a flat pack blank of the corrugated board foldable into a box.

In the second aspect, the present invention provides a ventilation board, comprising a three or more ply corrugated board having a top liner, a bottom liner, and an intermediate corrugated layer having a plurality of flutes, said flutes having a plurality of crests and troughs. According to the present invention, a first depressed portion is on the top liner therein and a second depressed portion is provided on the bottom liner. According to the present invention, the second depressed portion is provided to the first depressed portion mutually adjacent and non-overlapping such that the crests and troughs of the flutes between the first and second depressed portions are exposed to form a plurality of passageways for passage of fluid across the board. According to the present invention, the first depressed portion is formed by a first cut penetrating through the top liner and the plurality of flutes of the corrugated layer only and depressing the cut to form the said depressed portion. Similarly, the second depressed portion is formed by a second cut penetrating through second liner and the plurality of flutes of the corrugated layer only and depressing the cut to form the said depressed portion.

According to an embodiment of the present invention, the first cut includes one or more cuts passing through the top liner and flutes of the corrugated layer, and the second cut includes one or more cuts passing through the bottom liner and flutes of the corrugated layer. In other word, a plurality of cuts is formed on the top and bottom of the corrugated board for forming a mutually adjacent and non-overlapping plurality of the depressed portions depending upon the degree of the ventilation required for hot food or agricultural products.

According to one another embodiment of the present invention, the first and second cuts are formed at an angle with orientation of the plurality of flutes. According to the present invention, dimensions of the first and second cuts are either same or different. Advantageously, the cuts can be formed of any shapes including lines, geometrical shapes, design patterns, alphabetical shapes, and logos.

According to the present invention, the ventilation board can be made of at least one material including, in a non-limiting list, paper, paper board, white paper, K raft paper, duplex board, laminated paper, coated paper, butter paper, a plastics material, high density polyethylene, low density polyethylene, polyethylene, polypropylene, polystyrene, poly carbonates, PET, PVC, metal, including metal sheeting, galvanized iron, aluminum, alloy, sheets of wire or mesh, woven or non-woven fabrics, a compound material or in combination thereof.

In the third aspect, the present invention provides an apparatus for manufacturing a ventilation board by a method of the first aspect or a ventilation board of the second aspect of the present invention. Said apparatus comprises a cutting means for performing a cut on a corrugated board up to a predetermined depth so that the cut does not pass through the board and a pressing means to depressed a portion at the cut of the board.

According to an embodiment of the apparatus of the third aspect of the present invention, the cutting means includes one or more cutters to perform the cut at one side or both side of the corrugated board simultaneously.

According to an embodiment of the apparatus of the third aspect of the present invention, the pressing means is a pressing plate to depress the cut for forming a depressed portion on the corrugated board and can be combined with the cutting means for carrying out the cutting and depressing steps simultaneously or adapted subsequently to the cutting means to carry out the step of depressing after the cutting step.

According to an embodiment of the apparatus of the third aspect of the present invention, the apparatus can be a platent punching, rotary cutting creasing and pressing machine, rotary die cutting machine or flatbed die cutting machine.

In the fourth aspect, the present invention provides a ventilation board comprising a three or more ply corrugated board having an intermediate corrugated layer sandwiched between two liners, said corrugated layer having a plurality of flutes. The ventilation board comprises an aperture on the one of the liners; and a depressed portion formed by cutting the other liner along with the flutes of the corrugated layer and depressing the cut portion of the other liner with the flutes of the corrugated layer, such that the depressed potion is adjacent and non-overlapping to the aperture and the plurality of flutes between the aperture and the depressed portion are exposed to form a plurality of passageways for passage of fluid across the board.

According to an embodiment of the ventilation board of the forth aspect of the present invention, the aperture is provided on the liner and the intermediate corrugated layer but do not pass through the other liner.

According to an embodiment of the present invention, the aperture provided on the liner or aperture provided on the liner and the corrugated layer are formed before the formation of the corrugated board.

The present invention also provides two methods for manufacturing a ventilation board of the fourth aspect.

In the first method, it comprises steps of forming an aperture on a first liner; forming a corrugated board by affixing the said first liner on a two ply corrugated sheet, said corrugated sheet having a second liner affixed on a corrugated layer having plurality of flutes; forming a cut passing through the liner and corrugated layer of the corrugated sheet such that the cut does not penetrate through the first liner, said cut being mutually adjacent and non-overlapping to the aperture; and depressing at the cut to form a depressed portion such that the flutes between the aperture and the depressed portion are exposed to form a plurality of passageways for passage of fluid across the board.

In the second method, it provides steps of forming an aperture on a two ply corrugated sheet having a first liner affixed on a corrugated layer having plurality of flutes; forming a corrugated board by affixing a second liner on the corrugated sheet forming a cut passing through the second liner and the corrugated layer of the corrugated sheet such that the cut does not penetrate through the liner of the corrugated sheet, said cut being mutually adjacent and non-overlapping to the aperture of the corrugated sheet and depressing at the cut to form depressed portion such that the flutes between the aperture and the depressed portion are exposed to form a plurality of passageways for passage of fluid across the board.

In the fifth aspect, the present invention provides a ventilation board formed from a two ply corrugated sheet having a liner affixed with a corrugated layer, said ventilation board comprising: an aperture on the liner and a depressed portion on the corrugated layer, the depressed portion is adjacent and non-overlapping to the aperture such that the troughs of the flutes between the aperture and depressed portions are exposed to form a plurality of passageways for passage of fluid across the sheet. According to an embodiment of the present invention, the aperture is formed on the liner before affixing the liner to the corrugated layer to form a two ply sheet. The present invention also provides a method for manufacturing a ventilation board of the fifth aspect, comprising steps of forming an aperture on a liner; affixing the liner with the corrugated layer to form a corrugated sheet forming a cut on the corrugated layer such that the cut does not penetrate through the liner, said cut being mutually adjacent and non-overlapping to the aperture formed on the liner; and depressing flutes at the cut to form a depressed portion such that the flutes between the aperture and the depressed portion are exposed to form a plurality of passageways for passage of fluid across the sheet.

BRIEF DESCRIPTION OF THE DRAWINGS

Reference will be made to embodiments of the present invention, examples of which may be illustrated in the accompanying figures. These figures are intended to be illustrative, not limiting. Although the present invention is generally described in the context of these embodiments, it should be understood that it is not intended to limit the scope of the present invention to these particular embodiments:

FIG. 1 shows a ventilation board in accordance with an embodiment of the present invention, wherein:

FIG. 2 shows cross-sectional views of the ventilation board of FIG. 1 in accordance with an embodiment of the present invention, wherein:

FIG. 4 shows a ventilation board in accordance with another embodiment of the present invention, wherein:

FIG. 5 shows a ventilation board in accordance with one another embodiment of the present invention, wherein:

FIG. 5A shows a top perspective view of the ventilation board in accordance of the said embodiment of the present invention; and FIG. 5B shows a bottom perspective view of the ventilation board of FIG. 5(A) in accordance of the said embodiment of the present invention;

FIG. 6 shows a ventilation board in accordance with one more another embodiment of the present invention, wherein:

DESCRIPTION OF THE PRESENT INVENTION

Figure 1A:
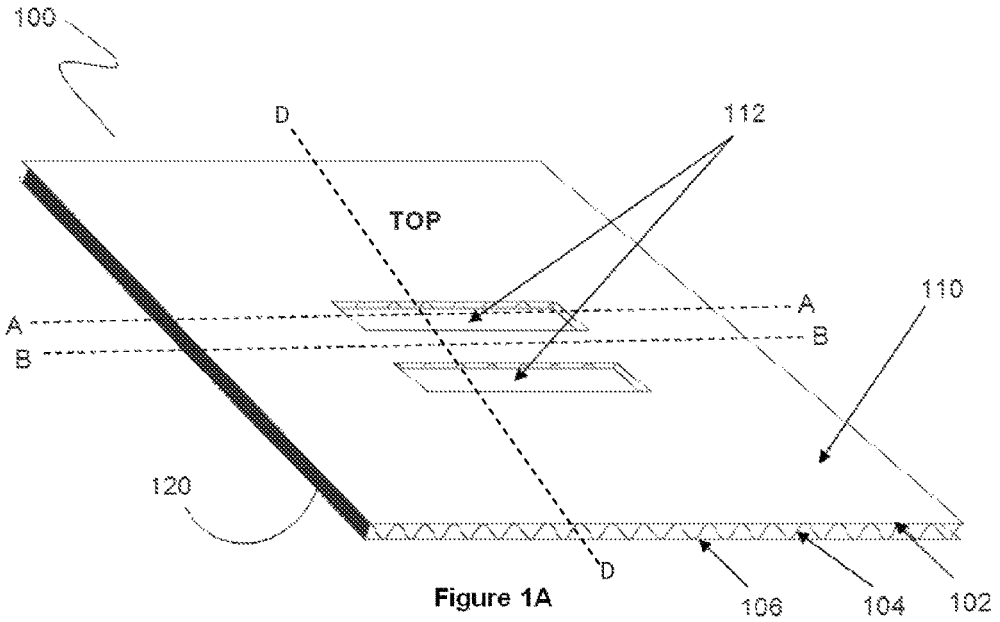
FIG. 1(A) shows a top perspective view of the ventilation board in accordance with an embodiment of the present invention.

Although specific terms are used in the following description for the sake of clarity, these terms are intended to refer only to the particular structure of the present invention selected for illustration in the drawings, and are not intended to define or limit the scope of the present invention.

References in the specification to 'one embodiment_ or 'an embodiment__ member that a particular feature, structure, characteristics, or function described in connection with the embodiment is included in at least one embodiment of the present invention. The appearances of the phrase 'in one embodiment__ in various places in the specification are not necessarily all referring to the same embodiment.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

The present invention provides a ventilation board and a method for manufacturing the ventilation board.

In general, the ventilation board of the present invention is manufactured from a corrugated board comprising at least one depressed portion on both side of the board in such a way that flutes of the corrugated layer between said depressed portions are exposed to form a plurality of passageways for passage of fluid across the board, in other word, from one side to other side of the board.

According to the method of the present invention, the depressed portion is formed by forming a cut on the surface of each side in such a way that the cut penetrating from one side of the board passes through the corrugated layer of the corrugated board but does not pass through the other side of the corrugated board and depressing the cut in such a way that the flutes between the depressed portion get exposed in order to provide passageways for passage of the fluid from one side to the other side of the board. Further, the cuts of the one side of the board are non-overlapping with the cuts of the other side of the board. Advantageously, the step of forming cuts includes forming two parallel cuts and the step of depressing includes depressing the portion between the two parallel cuts to form a depressed portion. Alternatively, single cut can be formed and a portion of one of the side of the cut can be depressed to expose the flutes in order to connect the flutes exposed by the depressed portion of the opposite side. Further, a cut can be square, circular, oblong to form depressed portions.

The present invention also provides an apparatus for manufacturing the ventilation board. The apparatus comprises a cutting means for performing a cut on a corrugated board up to a predetermined depth so that the cut does not pass through the board and a pressing means to depressed a portion at the cut of the board. The cutting means includes one or more cutters to perform the cut at one side or both side of the corrugated board simultaneously and the pressing means is a pressing plate to depress the cut for forming a depressed portion on the corrugated board and is combine with the cutting means for carrying out the cutting and depressing steps simultaneously or adapted subsequently to the cutting means to carry out the step of depressing after the cutting step. The apparatus can be a platent punching, rotary cutting creasing and pressing machine, rotary die cutting or flatbed die cutting machine. The depth of the cutting can be predetermined and there are various means are available to fix the depth of the cutting and carry out the cutting up to the predetermined depth automatically or manually as well as by mechanical means. Hence, it is not described in the application in detail.

Further, the present invention also provides a ventilation board having an aperture on one side not penetrating through the other side and a depressed portion on the other side which is adjacent and non-overlapping to the aperture such that the flutes between the aperture and depressed portion are exposed to form a plurality of passageways for passage of fluid across the board. The aperture may be on the liner of the corrugated board and may be passing through the liner and corrugated layer of the corrugated board but does not passing through the other liner of the corrugated board.

In the following description, like reference characters designate like or corresponding parts throughout the figures. Additionally, in the following description and claims, it is understood that such terms as "top," "bottom," "one side," "other side," and the like are words of convenience and are not to be construed as limiting terms.

Referring now to FIG. 1, a ventilation board (100) is shown in accordance with an embodiment of the present invention. The ventilation board (100) has an intermediate corrugated layer (104) sandwiched between the two liners (102, 106). The intermediate corrugated layer (104) has multiple flutes running parallel to one of the edges of the board (100). The flutes define crests and troughs in the corrugated board (100).

In view of FIG. 1A, a liner (102) affixed on top of the intermediate corrugated layer (104) is hereinafter referred to as bottom liner (106). Similarly, a liner (106) affixed on top of the intermediate corrugated layer (104) is referred as top liner (102). The top liner (102) forms a top surface (110) of the ventilation board (100). The bottom liner (106) forms a bottom surface (120) of the ventilation board (100).

Figure 1B:
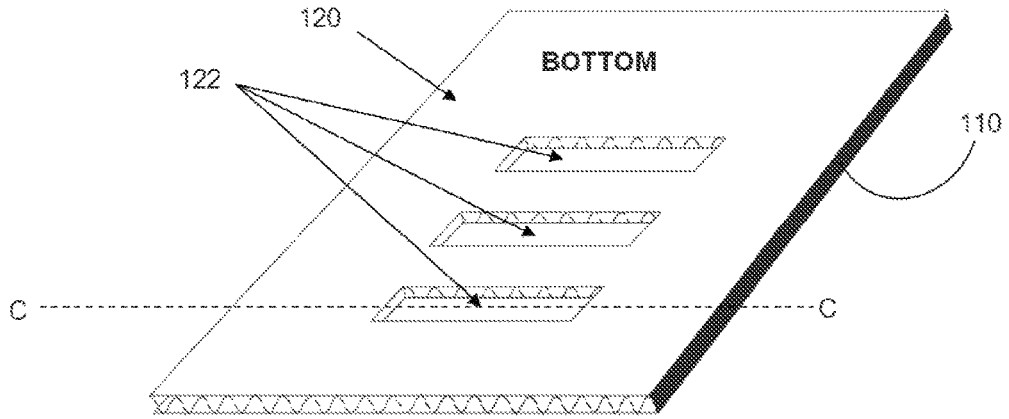
FIG. 1(B) shows a bottom perspective view of the ventilation board of FIG. 1(A) in accordance with an embodiment of the present invention.

In an embodiment of the present invention, two rectangular cuts are formed on the surface (110) of the top liner (102) and the rectangular cut portions thus formed are depressed to form two depressed portions (112) as shown in FIG. 1A. Similarly, three rectangular cuts are made on the surface (120) of the bottom liner (106) such that the rectangular cuts are adjacent to the two rectangular cuts made on the top liner (102) but are not overlapping. The rectangular portions of the bottom liner (106) are depressed to form three depressed portions (122) as shown in the FIG. 1B which are mutually adjacent without substantial overlap to the depressed portions (112) formed on the top liner (102) as shown in FIGS. 1A and 1B.

The cuts made on the top liner (102) passes through the top liner (102) and the intermediate corrugated layer (104) and do not penetrate through the bottom liner (106). Therefore, the depressed portions (112) is subjacent to the top liner (102) depressing the cut rectangular portion along with the intermediate corrugated layer (104).

The cuts made on the bottom liner (106) pass through the bottom liner (106) and the intermediate corrugated layer (104) and do not penetrate through the top liner (102). Therefore, the bottom depressed portions (122) is subjacent to the bottom liner (106) and is formed by depressing the bottom liner (106) along with the intermediate corrugated layer (104).

The cuts or depressed portion shown in FIG. 1 are rectangular in shape. However, according to the present invention, cuts can be of any shape including lines, geometrical shapes, design patterns, alphabetical shapes, and logos and can be of any dimensions either same or different as well as can be formed at any an angle with orientation of the plurality of flutes greater than the width of a corrugation of the corrugated layer.

Figure 2A:
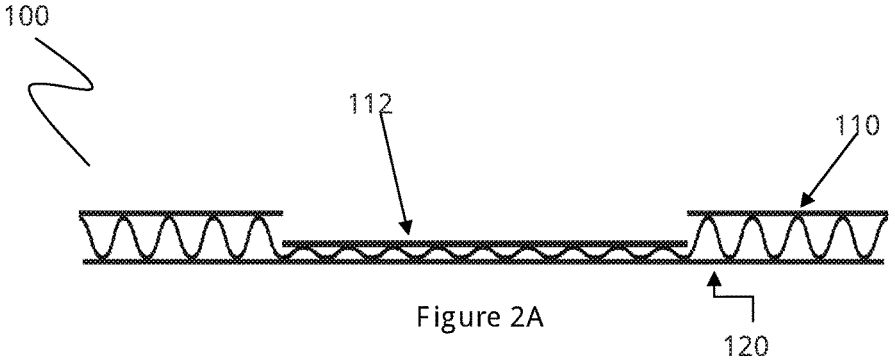
FIG. 2(A) shows a cross sectional view of the ventilation board of FIG. 1(A) at section A-A in accordance with an embodiment of the present invention.

Referring FIG. 2A shows a cross sectional view of the ventilation board (100) at section A-A of FIG. 1A. As seen in FIG. 2A, the top portions (112) expose the crests and troughs of the flutes at edges of the top depressed portions (112).

Figure 2B:
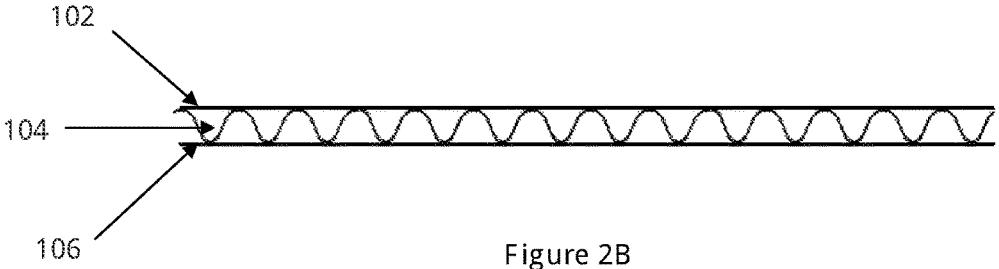
FIG. 2(B) shows a cross sectional view of the ventilation board of FIG. 1(A) at section B-B in accordance with an embodiment of the present invention.

Referring FIG. 2B shows a cross sectional view of the ventilation board (100) at section B-B of FIG. 1A. As seen in FIG. 2B, the crests and troughs of the flutes beneath the top depressed portions (112) connect the top depressed portions (112) to the bottom depressed portions (122) to form continuous passages within the flutes thereof.

Figure 2C:
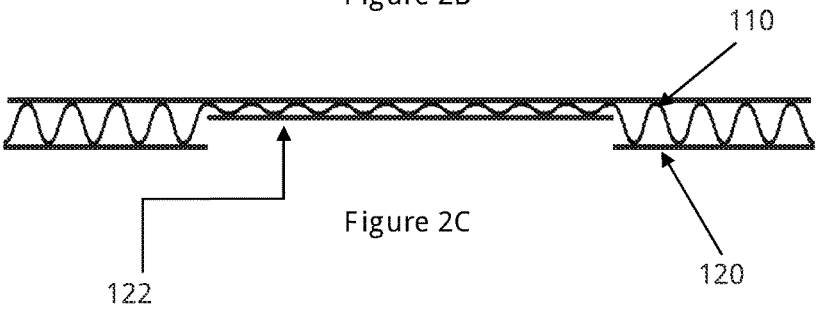
FIG. 2(C) shows an inverted cross sectional view of the ventilation board of FIG. 1(B) at section C-C in accordance with an embodiment of the present invention.

Referring FIG. 2C shows an inverted cross sectional view of the ventilation board (100) at section C-C of FIG. 1B as FIG. 1B is the bottom side of the board. As seen in FIG. 2C, the bottom depressed portions (122) expose the crests and troughs of the flutes at edges of the bottom depressed portion (122).

Therefore, as seen in FIGS. 2A-2C, the flutes of the depressed portions are depressed along with the liner and the flutes between the depressed portions (112 and 122) of top and bottom are connected to form passages that allows fluid including steam, air to move from one side to another side of the board. In other words, the exposure of the flutes at the edges of the top and bottom depressed portions (112 and 122) opens up the passages to atmospheric air and to inside of the storage container. This provides open passages for air and/or steam to flow from inside the container to the atmosphere by way of the open passages formed between the top and bottom depressed portions (112 and 122), thereby providing ventilation to the storage container. The fluid may travel from bottom side to the top side of the board and/or from top side to bottom side of the board though passages formed by the flutes between the top and bottom depressed portions thereby provides breathing to the agricultural products and ventilation to the hot foods by allowing excess steam to release in the atmosphere.

Figure 3:
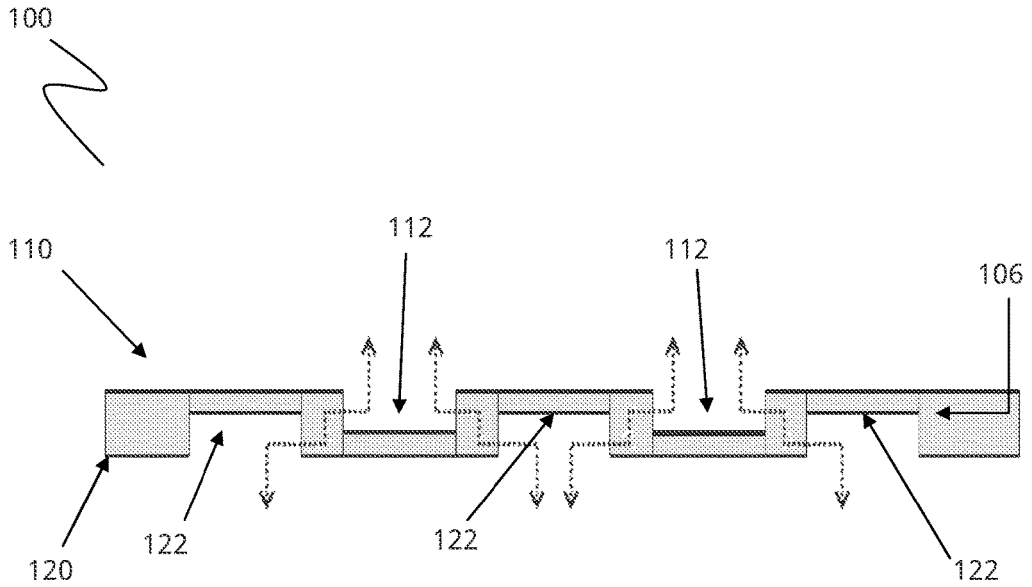
FIG. 3 shows a side cross sectional view of the ventilation board of FIG. 1A at Section D-D in accordance with an embodiment of the present invention.

Referring FIG. 3 shows a side cross sectional view of the ventilation board (100) in accordance with an embodiment of the present invention. As shown in FIG. 3 and as explained in FIGS. 2A-2C, open passages are formed (and are indicated by dotted arrows in FIG. 3) between the top and bottom depressed portions (112 and 122) for the movement of the fluid across the board.

According to the present invention, the ventilation board can be manufactured from a corrugated board having more than three plies, with a top liner, a bottom liner, and multiple inner liners. For example, it is known that a corrugated board with five plies has a top liner, a bottom liner, an intermediate liner, and two intermediate corrugated layers. The first and second intermediate corrugated plies have multiple flutes with multiple crests and troughs. In this case, the top liner can have one or more cuts which may penetrate from first corrugated layer to last corrugated layer and similarly the bottom liner has one or more cuts which are aligned and non-overlapping with the cuts provided on the top liner. On depression of both side cuts, the flutes of the one or both corrugated layers connect with each other forming passageways for the passage of fluid from one side to the other side of the ventilation board.

Figure 7:
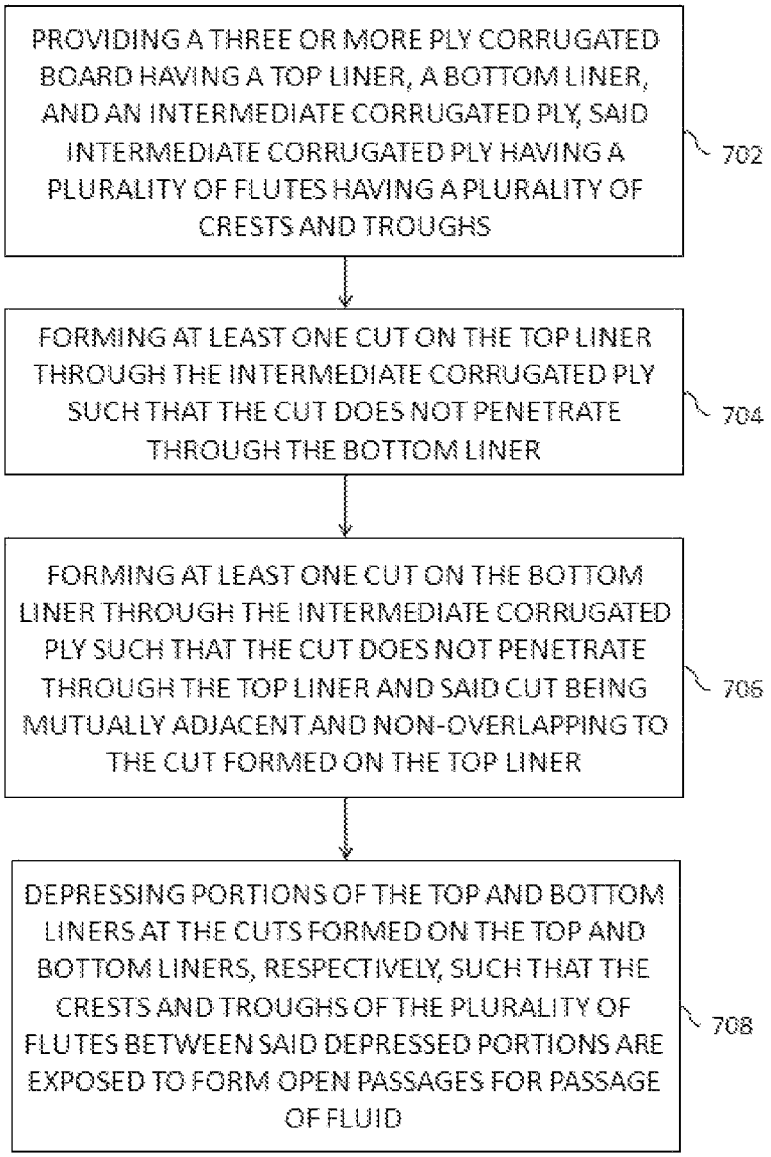
FIG. 7 shows a flowchart illustrating a method of manufacturing a ventilation board in accordance with an embodiment of the present invention.

Referring now to FIG. 7 which shows a flowchart of a method of manufacturing the ventilation board in accordance with an embodiment of the present invention. In an embodiment, the method of FIG. 7 is performed by a ventilation board manufacturing apparatus (not shown) that manufactures the ventilation board (100) as described in FIGS. 1-4.

At step 702, the three or more ply corrugated board having the top liner, the bottom liner, and the intermediate corrugated layer is provided. Said intermediate corrugated layer has the plurality of flutes having the plurality of crests and troughs.

At step 704, the ventilation board manufacturing apparatus of the present invention forms at least one cut passing through the top liner and intermediate corrugated layer such that the cut does not penetrate through the bottom liner.

At step 706, the ventilation board manufacturing machine forms at least one passing through the bottom liner and intermediate corrugated layer such that the cut does not penetrate through the top liner and said cut being mutually adjacent and non-overlapping to the cut formed on the top liner.

At step 708, the ventilation board manufacturing machine forms the top depressed portions and the bottom depressed portions of the top and bottom liners along with the corrugated layer at the cuts formed on the top and bottom liners, respectively, such that the crests and troughs of the plurality of flutes between the top and bottom depressed portions are exposed to form a plurality of passageways. In an alternative embodiment of the method of FIG. 7, the ventilation board manufacturing machine performs two or more of the steps 704-708 simultaneously, subsequently, together or separately.

The flutes between the depressed portions are connected at the edges and form open passages for passage of air from within the storage container to outside the storage container, thereby providing ventilation for the storage container. T his prevents the food within the storage container from becoming soggy.

Specifically, the crests and troughs of the flutes between the adjacent depressed portions act as ventilation passages for the storage container whereas, the flutes that do not lie between any two adjacent depressed portions or the flutes which are exposed and not between the top and bottom depressed portions function as insulators and helps to keep food hot as well as the steam condensed within the flutes between the liners of the board. This prevents the food from becoming cold, thereby ensuring that the food within the storage container remains hot for a long period of time and less soggy. Further, the ventilation board conserves heat within the storage container (for e.g. pizza-box) and at the same time ventilates excess vapour, steam, humidity moisture and vapour out of the storage container, thereby reducing chances of hot food (for e.g. pizza) within the storage container from becoming soggy.

Also, the ventilation board provides improved ventilation in the storage container (for e.g. pizza-box) and insulates the storage container for conserving temperature difference between inside and outside of the storage container, thereby making the ventilation board a useful material for fast food packaging (for e.g. pizza).

Advantageously, steam from within the storage container is released directly into atmosphere through the depressed portions with no substantial risk of external objects (or particles) dropping into the storage container through the ventilation board. Hence, the ventilation board ventilates the food products including hot foods as well as agricultural products within the storage container without contaminating the same.

Alternatively, the ventilation board may be arranged to be used in articles including, but not limited to, a bag, a cover, a paper pouch, a paper utensil, a pot, a vase, a bucket, a coaster, a wrapper, a lid, an item of luggage, a shoe, a shoe sole, a cap, a helmet and can be arranged to be used in microwave ovens, in refrigeration units, or both.

Figure 4A:
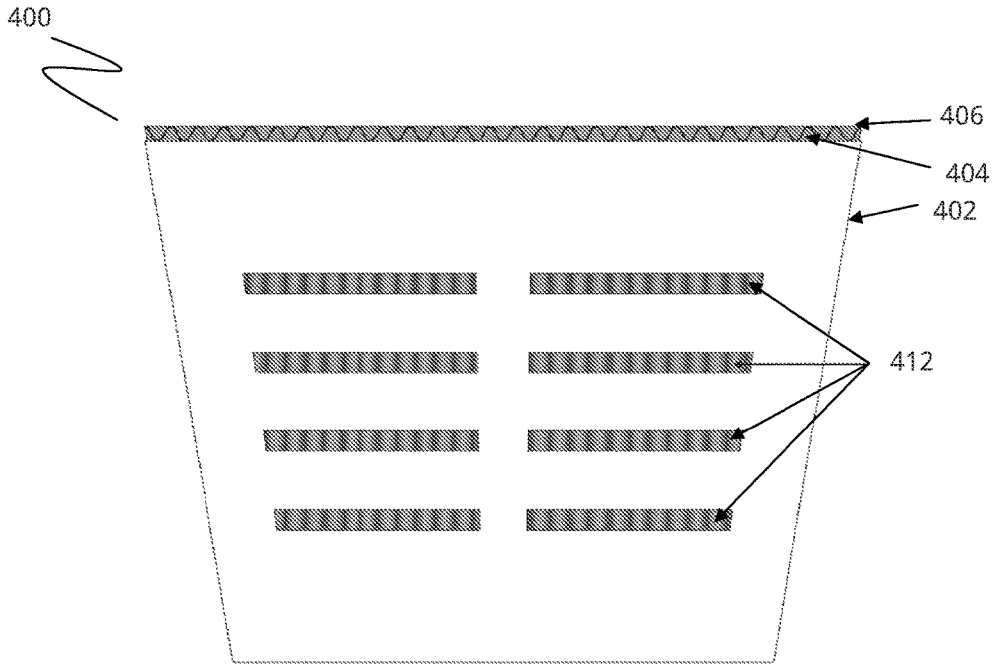
FIG. 4A shows a top perspective view of the ventilation board in accordance of the said embodiment of the present invention.
Figure 4B:
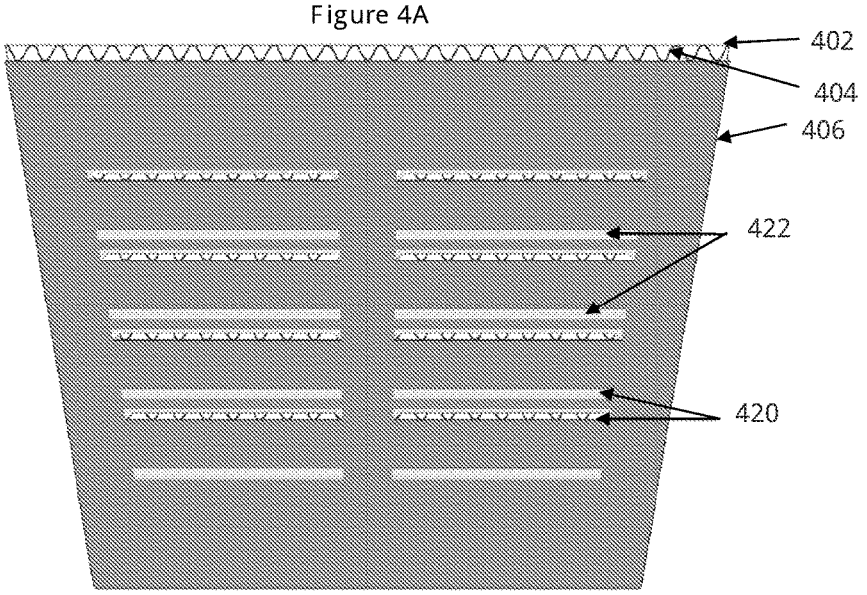
FIG. 4B shows a bottom perspective view of the ventilation board of FIG. 4(A) in accordance of the said embodiment of the present invention.

Referring now FIG. 4A shows a top perspective view of a ventilation board (400) made from a three ply corrugated board in accordance with another embodiment of the present invention. The ventilation board (400) includes a top liner (402), and intermediate corrugated layer (404), and a bottom liner (406). The intermediate corrugated layer (404) has multiple flutes having multiple crests and troughs therein. The top liner (402) has apertures (412). As shown in the FIG. 4A, the apertures (412) expose the flutes of the intermediate corrugated layer (404) underneath. The bottom liner (406) has multiple depressed portions (422) such that the depressed portions (422) are mutually adjacent and non-overlapping to the apertures (412). The depressed portion of the bottom liner (406) formed by forming parallel cuts (420) and depressing a potion between the two adjacent parallel cuts (420) to form depressed portions (422). The flutes of the corrugated layer (404) between apertures (412) and the depressed portions (422) are connected and form open passageways for passage of fluid across the board (400), that is, from one side of the ventilation board (400) to the other side of the ventilation board (400), thereby providing ventilation. The present invention also provides a method for manufacturing the ventilation board as shown in FIG. 4 comprising steps of: forming an aperture on a first liner; forming a corrugated board by affixing the said first liner on a two ply corrugated sheet, said corrugated sheet having a corrugated layer affixed on a second liner; forming a cut passing through the liner and corrugated layer of the corrugated sheet such that the cut does not penetrate through the first liner, said cut being mutually adjacent and non-overlapping to the aperture formed on the liner; and depressing at the cut to form a depressed portion such that the flutes between the aperture and the depressed portion are exposed to form a plurality of passageways for passage of fluid across the board.

Specifically, the trough of flutes extends from the apertures (412) to the depressed portions (422) act as ventilation passages for the storage container whereas, the flutes that do not connect the apertures (412) with the depressed portions (422) or depressed portions (422) with the apertures (412) function as insulators. T his prevents the food from becoming cold, thereby ensuring that the food within the storage container remains hot for a long period of time without becoming soggy by allowing excess steam to release in the atmosphere.

Figure 5:
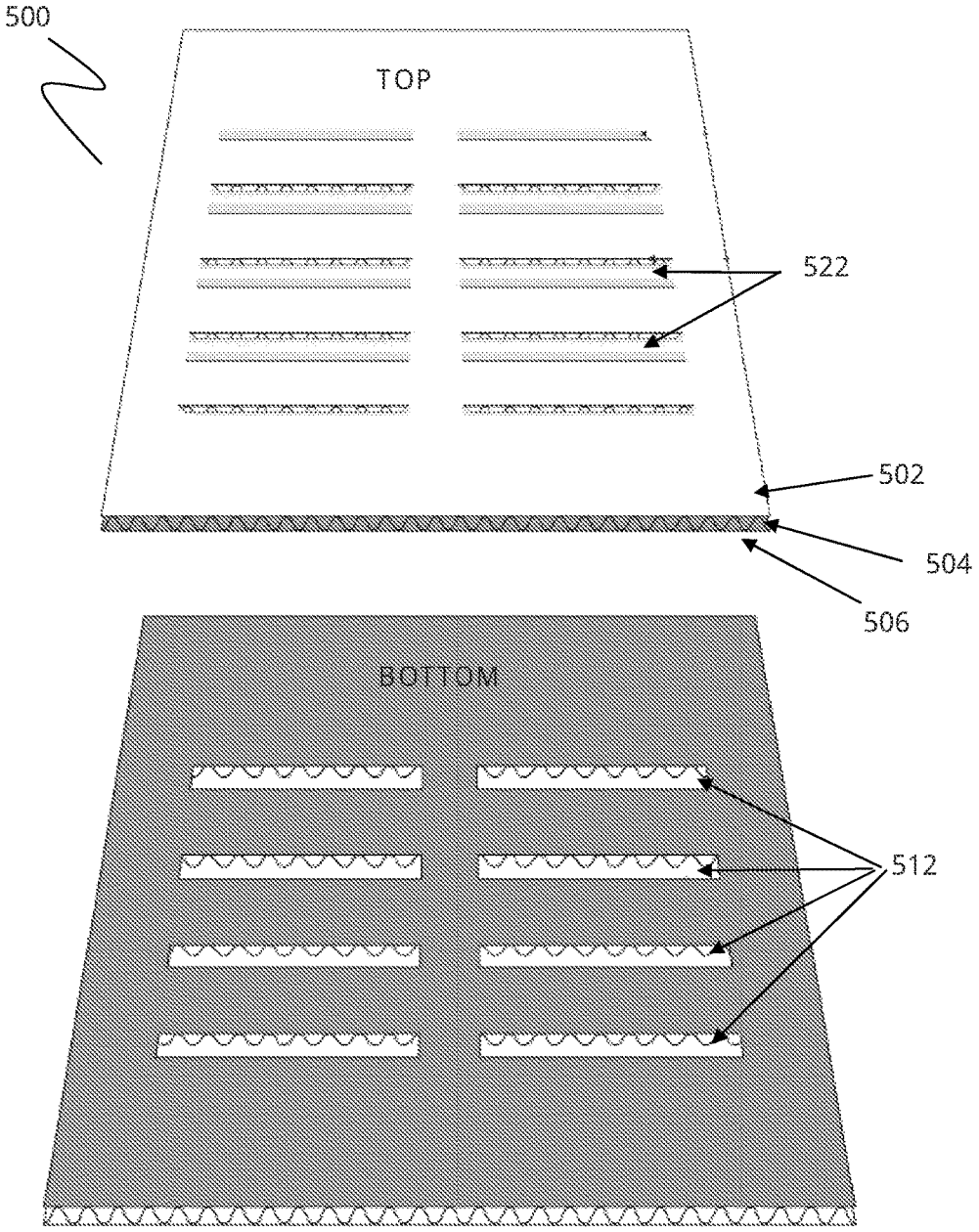

Referring FIG. 5 through FIGS. 5A and 5B shows one another embodiment of the ventilation board (500) according to the present invention made from a three ply corrugated board. The bottom liner (506) and the corrugated layer (504) has apertures (512) and the said apertures are made before the formation of the corrugated board. The apertures (512) expose the top liner (502). The top liner (502) has multiple depressed portions (522) such that the depressed portions (522) are mutually adjacent and non-overlapping to the apertures (512). The depressed portions (522) are made by cutting the top liner (502) and the corrugated layer (504) on the corrugated board having the apertures (512) which are formed before the formation of the corrugated board and the cut portions are depressed to form a ventilation board (500) according to the present invention. The crests and troughs of the corrugated layer (504) between apertures (512) and the depressed portions (522) are connected and form open passageways for passage of fluid from one side of the ventilation board (500) to the other side of the ventilation board (500), thereby providing ventilation. The present invention also provides a method for manufacturing the ventilation board as shown in FIG. 5, said method comprising steps of: forming an aperture on a two ply corrugated sheet having a first liner affixed on a corrugated layer; forming a corrugated board by affixing a second liner on the corrugated sheet forming a cut passing through the second liner and the corrugated layer of the corrugated sheet such that the cut does not penetrate through the liner of the corrugated sheet, said cut being mutually adjacent and non-overlapping to the aperture of the corrugated sheet; and depressing at the cut to form depressed portion such that the flutes between the aperture and the depressed portion are exposed to form a plurality of passageways for passage of fluid across the board.

Figure 6A:
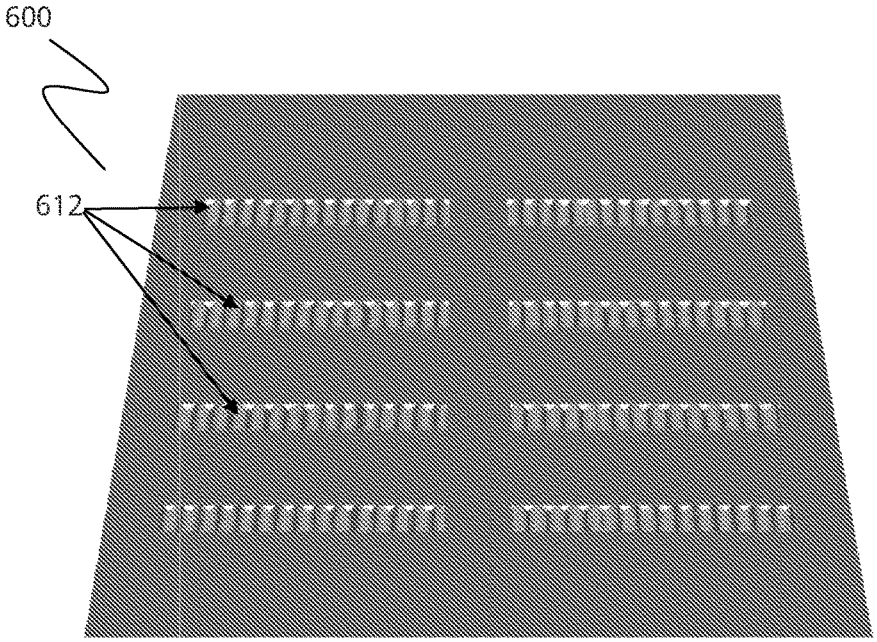
FIG. 6A shows a top perspective view of the ventilation board in accordance of the said embodiment of the present invention.
Figure 6B:
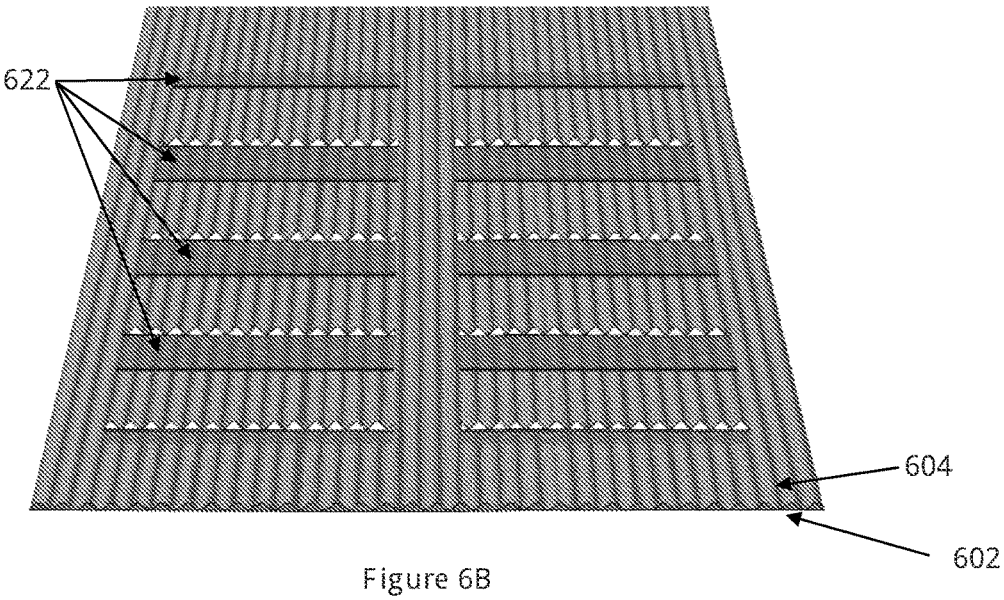
FIG. 6B shows a bottom perspective view of the ventilation board of FIG. 6A in accordance of the said embodiment of the present invention.

Referring FIG. 6 shows one more another embodiment of the present invention a ventilation board (600) made from two ply corrugated sheet. The two ply corrugated sheet comprises a corrugated layer (604) affixed to the liner (602). As shown in FIG. 6, the corrugated layer (604) has depressed portions (622) and the liner (602) has apertures (612) adjacent and non-overlapping with the depressed portion (622). The flutes connecting the depressed portion (622) and the aperture (612) act as passageways for passage of fluid from one side of the ventilation board (600) to the other side of the ventilation board (600), thereby providing ventilation. The present invention also provides a method for manufacturing the ventilation board as shown in FIG. 6 from a corrugated sheet having one liner and a corrugated layer, said method comprising steps of: forming an aperture on a liner; affixing the liner with the corrugated layer to form a corrugated sheet forming a cut on the corrugated layer such that the cut does not penetrate through the liner, said cut being mutually adjacent and non-overlapping to the aperture formed on the liner; and depressing flutes at the cut to form a depressed portion such that the flutes between the aperture and the depressed portion are exposed to form a plurality of passageways for passage of fluid across the sheet.

The ventilation board of the present invention can be made of at least one material including, but not limited to, paper, paper board, white paper, K raft paper, duplex board, laminated paper, coated paper, butter paper, plastics material, high density polyethylene, low density polyethylene, polyethylene, polypropylene, polystyrene, poly carbonates, PET, PVC, metal, including metal sheeting, galvanized iron, aluminum, alloy, woven or non-woven fabrics, and a compound material, or in combination of said materials. Advantageously, the ventilation board is made of a single material or a combination of materials. Preferably, the ventilation board is made of paperboard. It will be apparent to a person of skill in the art that the paperboard material is suited, advantageously, for items such as disposable packaging due to its low weight and low cost.

The ventilation board of the present invention is very easy to manufacture. The ventilation board of the present invention for manufacturing does not require to modification in the current manufacturing line of the corrugated boards as the cutting and depressions are required to be done after the formation of the corrugated board. It can be manufacture at any stage after the formation of the corrugated board for example the board of the present invention can be manufactured at Hot food delivery stations such as pizza stations, wherein the station will have a portable apparatus as claimed in this application for forming the depressed portions based and the type of the hot food to be delivered, on their flat pack blank of the foldable box. The ventilation board of the present invention can be implemented in various articles including, but not limited to containers, covering lids, side panels, or a bottom panels of the containers.

The terms first, second, bottom, top, intermediate, mutually adjacent etc. are used in the specification for understanding purpose and are not limiting the present invention to the meaning of said nouns.

It will be apparent to one of the ordinary skill in the art that many modifications, improvements and sub-combinations of the various embodiments, adaptations and variations can be made to the present invention without departing from the scope thereof as claimed in the following claims:

The invention claimed is:

1. A method of manufacturing a ventilation board, said method comprising steps of:

providing a three or more ply corrugated board having a top liner a bottom liner, and an intermediate corrugated layer, said intermediate corrugated layer having a plurality of flutes forming a plurality of crests and troughs;

forming at least one cut passing through the top liner and the corrugated layer such that the cut does not penetrate through the bottom liner;

forming at least one cut passing through the bottom liner and the corrugated layer such that the cut does not penetrate through the top liner and said cut being mutually adjacent and non-overlapping to the cut formed on the top liner; and depressing portions of the top and bottom liners along with the flutes of the corrugated layer such that flutes on one side of a given cut cut are depressed and flutes on the other side of the given cut are not depressed, thereby providing ventilation across the corrugated board between the cut passing through the top liner and the cut passing through the bottom liner.

2. The method as claimed in claim 1, further comprising steps of:

forming two cuts on the top liner, wherein the top liner along with the flutes between two cuts formed on the top liner are depressed to form a first depressed portion, and forming two cuts on the bottom liner, wherein the bottom liner along with the flutes between two cuts formed on the bottom liner are depressed to form a second depressed portion, thereby the crests and troughs of the flutes between the first and second depressed portions are exposed to form a plurality of passageways for passage of fluid across the board for providing ventilation.

3. The method as claimed in claim 2, wherein the step of forming cuts includes forming a single cut and the step of depressing includes depressing one of the adjacent sides of the cut to form a depressed portion.

4. The method as claimed in claim 2, wherein the step of forming cuts preferably includes forming two parallel cuts and the step of depressing includes depressing the portion between the two parallel cuts to form a depressed portion.

5. The method as claimed in claim 1, wherein the step of forming the cuts and the step of depressing the portions at the cuts are performed simultaneously, subsequently, together or separately.

6. The method as claimed in claim 1, wherein the step of forming the cuts includes forming a single cut and the step of depressing includes depressing one of the adjacent sides of the cut to form a depressed portion.

7. The method as claimed in claim 1, wherein the step of forming cuts preferably includes forming two parallel cuts and the step of depressing includes depressing the portion between the two parallel cuts to form a depressed portion.

8. The method as claimed in claim 1, wherein the step of providing a three or more ply corrugated board includes:

forming the corrugated board; or providing a corrugated board before making a flat pack blank; or providing a flat pack blank of the corrugated board foldable into a box.

9. The method as claimed in claim 1, wherein the cuts on the top and bottom liners are formed at an angle with an orientation of the plurality of flutes.

10. The method as claimed in claim 1, wherein shapes of the cuts formed on the top and bottom liners include lines, geometrical shapes, design patterns, alphabetical shapes, and logos.

11. A ventilation board, comprising:

a three or more ply corrugated board having a top liner, a bottom liner, and an intermediate corrugated layer having a plurality of flutes, said flutes having a plurality of crests and troughs;

a first depressed portion on the top liner therein formed by depressing the top liner and the flutes of the corrugated layer; and a second depressed portion on the bottom liner therein formed by depressing the bottom liner and the flutes of the corrugated layer, wherein the second depressed portion is adjacent to the first depressed portion and mutually adjacent and non-overlapping such that the crests and troughs of the flutes between the first and second depressed portions are exposed to form a plurality of passageways for passage of fluid across the board.

12. The ventilation board as claimed in claim 11, wherein the first depressed portion is formed by a first cut penetrating through the top liner and the plurality of flutes of the corrugated layer only and depressing the first cut to form the first depressed portion such that flutes on one side of the first cut are depressed and flutes on the other side of the first cut are not depressed, and the second depressed portion is formed by a second cut penetrating through the bottom liner and the plurality of flutes of the corrugated layer only and depressing the second cut to form the second depressed portion, such that flutes on one side of the second cut are depressed and flutes on the other side of the second cut are not depressed.

13. The ventilation board as claimed in claim 12, wherein the first cut includes one or more cuts passing through the top liner and the flutes of the corrugated layer, and the second cut includes one or more cuts passing through the bottom liner and the flutes of the corrugated layer.

14. The ventilation board as claimed in claim 12, wherein the first and second cuts are formed at an angle with an orientation of the plurality of flutes and are greater than a width of a corrugation of the corrugated layer.

15. The ventilation board as claimed in claim 12, wherein dimensions of the first and second cuts are either same or different.

16. The ventilation board as claimed in claim 12, wherein shapes of the cuts formed on the top and bottom liners include lines, geometrical shapes, design patterns, alphabetical shapes, and logos.

17. The ventilation board as claimed in claim 11, wherein the ventilation board is made of at least one material including, in a non-limiting list, paper, paper board, white paper, Kraft paper, duplex board, laminated paper, coated paper, butter paper, a plastics material, high density polyethylene, low density polyethylene, polyethylene, polypropylene, polystyrene, poly carbonates, PET, PVC, metal, including metal sheeting, galvanized iron, aluminum, alloy, sheets of wire or mesh, woven or non-woven fabrics, a compound material or a combination thereof.

18. An apparatus for manufacturing the ventilation board as claimed in claim 11, said apparatus comprising a cutting means for performing a cut on the corrugated board up to a predetermined depth so that the cut does not pass through the board and a pressing means to depress a portion at the cut of the board.

19. The apparatus as claimed in claim 18, wherein the cutting means includes one or more cutters to perform the cut at one side or both sides of the corrugated board simultaneously.

20. The apparatus as claimed in claim 18, wherein the pressing means is a pressing plate to depress the cut for forming the depressed portions on the corrugated board and can be combined with the cutting means for carrying out the cutting and depressing steps simultaneously or adapted subsequently to the cutting means to carry out the step of depressing after the cutting step.

21. The apparatus as claimed in claim 18, wherein the apparatus can be a platent punching, rotary cutting creasing and pressing machine, rotary die cutting or flatbed die cutting machine.

22. A ventilation board, comprising:

a three or more ply corrugated board having an intermediate corrugated layer sandwiched between two liners, said corrugated layer having a plurality of flutes;

an aperture on one of the liners; and a depressed portion formed by cutting the other liner along with the flutes of the corrugated layer and depressing the cut portion of the other liner with the flutes of the corrugated layer, such that the depressed portion is adjacent and non-overlapping to the aperture and the plurality of flutes between the aperture and the depressed portion are exposed to form a plurality of passageways for passage of fluid across the board.

23. The ventilation board as claimed in claim 22, wherein the aperture passes through the liner and the intermediate corrugated layer only.

24. The ventilation board as claimed in claim 22, wherein the aperture is made before the formation of the corrugated board.

25. A ventilation board formed from a two ply corrugated sheet having a liner affixed with a corrugated layer, said ventilation board comprising:

an aperture on the liner; and a depressed portion on the corrugated layer, the depressed portion is adjacent and non-overlapping to the aperture such that the troughs of the flutes between the aperture and the depressed portion are exposed to form a plurality of passageways for passage of fluid across the sheet.

26. The ventilation board as claimed in claim 25, wherein the aperture is formed on the liner before affixing the liner to the corrugated layer to form a two ply sheet.

27. A method for manufacturing a ventilation board from a corrugated sheet having one liner and a corrugated layer, said method comprising steps of:

forming an aperture on a liner;

affixing the liner with the corrugated layer to form a corrugated sheet;

forming a cut on the corrugated layer such that the cut does not penetrate through the liner, said cut being mutually adjacent and non-overlapping to the aperture formed on the liner; and depressing the liner and flutes of the corrugated layer lying on one side of the cut to form a depressed portion such that the flutes between the aperture and the depressed portion are exposed to form a plurality of passageways for passage of fluid across the sheet and such that the flutes on the other side of the cut are not depressed, thereby providing ventilation across the corrugated board.

28. A method for manufacturing a ventilation board from a three or more ply corrugated board, said method comprising steps of:

forming an aperture on a first liner;

forming a corrugated board by affixing the first liner on a two ply corrugated sheet, said corrugated sheet having a second liner affixed on a corrugated layer having a plurality of flutes;

forming a cut passing through the first liner and the corrugated layer of the corrugated sheet such that the cut does not penetrate through the first liner, said cut being mutually adjacent and non-overlapping to the aperture formed on the first liner; and depressing the first liner and the flutes on one side of the cut to form a depressed portion such that the flutes on the other side of the cut are not depressed and the flutes between the aperture and the depressed portion are exposed to form a plurality of passageways for passage of fluid across the board.

29. A method for manufacturing a ventilation board from a three or more ply corrugated board having a corrugated layer sandwiched between two liners, said method comprising steps of:

forming an aperture on a two ply corrugated sheet having a first liner affixed on a corrugated layer having plurality of flutes;

forming a corrugated board by affixing a second liner on the corrugated sheet;

forming a cut passing through the second liner and the corrugated layer of the corrugated sheet such that the cut does not penetrate through the first liner of the corrugated sheet, said cut being mutually adjacent and non-overlapping to the aperture of the corrugated sheet; and depressing the flutes on one side of the cut to form a depressed portion such that the flutes on the other side of the cut are not depressed and the flutes between the aperture and the depressed portion are exposed to form a plurality of passageways for passage of fluid across the board.

* * * * *